United States Patent [19]

Kaiser

[11] 3,999,593

[45] Dec. 28, 1976

[54] METHOD AND APPARATUS FOR PORE-FREE DIE CASTING

[75] Inventor: Willard D. Kaiser, Grove City, Ohio

[73] Assignee: International Lead Zinc Research Organization, Inc., New York, N.Y.

[22] Filed: Feb. 19, 1976

[21] Appl. No.: 659,426

[52] U.S. Cl. ..... 164/55; 164/113; 164/305; 164/318

[51] Int. Cl.[2] ..... B22D 27/20; B22D 17/04

[58] Field of Search ..... 164/55, 66, 67, 113, 164/119, 133, 136, 303, 305, 309, 314, 315, 316, 317, 318; 251/335 B, 334, 375, 214

[56] References Cited

UNITED STATES PATENTS

| | | | |
|---|---|---|---|
| 1,332,940 | 3/1920 | Wiedhofft | 164/119 X |
| 2,001,251 | 5/1935 | Irving | 251/335 B X |
| 2,042,541 | 6/1936 | Marinsky | 164/119 X |
| 2,652,223 | 9/1953 | Peters | 251/335 B |
| 3,382,910 | 5/1968 | Radtke | 164/113 X |
| 3,537,682 | 11/1970 | Priese | 251/214 |
| 3,724,491 | 4/1973 | Knudsen et al. | 137/375 |
| 3,779,304 | 12/1973 | Miki | 164/55 X |

FOREIGN PATENTS OR APPLICATIONS

| | | | |
|---|---|---|---|
| 1,200,481 | 1/1961 | Germany | 137/334 |
| 4,916,620 | 2/1974 | Japan | |

*Primary Examiner*—Ronald J. Shore
*Attorney, Agent, or Firm*—Brumbaugh, Graves, Donohue & Raymond

[57] ABSTRACT

In a hot chamber method of pore-free die casting, a gas which reacts with the cast material flushes air from a passage in a nozzle, sprue bushing, and at least a portion of a gooseneck through which the material fills the die cavity, as well as from the die cavity. The reactive gas replaces the air in the passage so that air is not forced into the die cavity by the material when it fills the die cavity. Air in the die cavity would form pores in the cast material. Hot chamber apparatus for practicing the method has a bore communicating with the passage for flushing the passage with the gas. A valve closes the bore when the material fills the die cavity so that the material only enters the die cavity. A heating element heats the valve to prevent the material from solidifying about the valve and thereby interfering with its operation.

8 Claims, 1 Drawing Figure

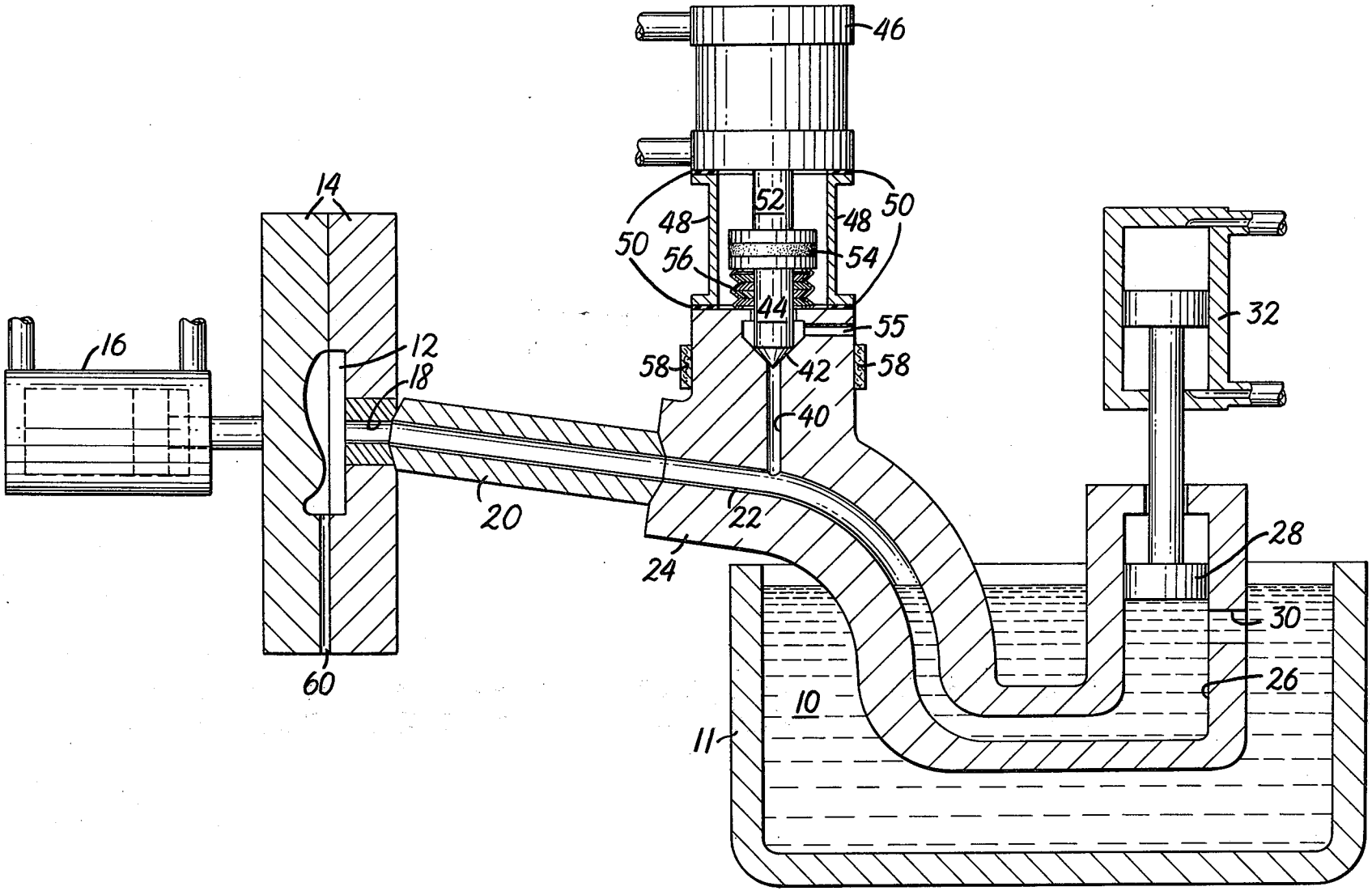
46
50
48
54
55
58
52
44
42
40
56
48
50
58
32
28
30
26
10
11
22
24
20
12
18
14
60
16

METHOD AND APPARATUS FOR PORE-FREE DIE CASTING

BACKGROUND OF THE INVENTION

This invention relates to die casting and more particularly to an improved method and hot chamber apparatus for pressure die casting.

Die casting is a well known way of shaping articles in which a liquid material, such as molten metal, is placed in a cavity which is formed in the shape of the desired article between separable die members. The liquid material fills the die cavity and solidifies therein in the shape of the desired article. The die members are then separated and the article removed from the die cavity. In pressure die casting, the liquid material is forced or injected into the die cavity under pressure.

Although die casting is a relatively easy way of forming articles, particularly articles having complex exterior surfaces which otherwise would be difficult to form, pores often form throughout the casting to significantly weaken the cast article. Such weak, porous articles are not suitable for many applications and articles for these applications have had to be manufactured by other, more expensive techniques.

Even though die casting and the problems presented by the porosity of cast articles have been long known, it was not until U.S. Pat. No. 3,382,910 issued on May 14, 1968 in the names of Radtke and Eck that a novel way of avoiding pores in cast articles became known. This patent, which is assigned to the same assignee as this application, describes a method of pore-free die casting in which the die cavity is purged of air (or other non-reactive gas or vapor) with a gas which reacts with the material to be cast in the die cavity. Such gas is herein called a reactive gas.

When the material is then cast, the reactive gas in the die cavity reacts with the material to form solid compounds therewith rather than the pores or bubbles which the non-reactive components of air in the die cavity would have formed in the cast article. For example, the patent describes flushing the die cavity with oxygen which reacts with a molten metal as it is cast in the die cavity to form small particles of oxides of the cast metal rather than pores or bubbles of trapped non-reactive gas.

Even though the practice of the method described in U.S. Pat. No. 3,382,910 produced articles which were significantly more pore-free than articles produced by conventional die casting, it has been found that some pores continue to be formed in articles cast according to the patented method in which only the die cavity is purged.

One attempt to control the formation of pores produced in cast articles suggests that portions of the article which first solidified shrank from still liquid portions of the material to form pores in the article. It then proposes to control, but not eliminate, the formation of such pores by controlling the places at which the cast article first cools and solidifies in the die cavity so that the pores from shrinkage of the material are formed in a portion of the cast article which can tolerate weakness from the pores or which may be removed from the finished article.

A proposal for further reducing the pores in an article cast in a die cavity which is filled with a reactive gas suggests placing a constricted gate at the place where the material enters the die cavity. The constricted gate produces a turbulence in the material injected into the die cavity to mix the injected material more completely with the reactive gas in the die cavity. Even if this proposal is more successful in reacting the gas with the material, it alone does nothing to eliminate non-reactive gas which may be injected into the die cavity with the material. Such non-reactive gas in the die cavity then forms pores in the cast article in the same way as if the die cavity had not been purged with the reactive gas before casting the material.

Two types of die casting apparatus are known. One type, often and herein called cold chamber apparatus, has a chamber just large enough to fill the die cavity once. This chamber is generally open to receive the individual shots of material to be cast. The open chamber can be easily flushed with a reactive gas (along with the die cavity) so that non-reactive gas is not forced into the die cavity ahead of the material to form pores in the casting.

The other type of die casting apparatus, often and herein called hot chamber apparatus, however, has a chamber or furnace holding a continuous supply of the material to be cast. This chamber is connected to the die cavity by an enclosed passage for filling the cavity for successive castings. Inasmuch as the passage is enclosed and blocked at one end by the supply of material to be cast, it cannot be readily flushed with reactive gas.

Flushing the die cavity with a reactive gas merely traps non-reactive gas in the passage between the cavity at one end and the material at the other. Filling the die cavity then forces the non-reactive gas into the die cavity where it forms pores in the casting.

Opening the passage so that it could be flushed like cold chamber apparatus cannot be done because the material would then escape through the opening as it fills the die cavity. In cold chamber apparatus, a plunger usually pushes the material away from the opening as it forces the material into the die. In hot chamber apparatus, however, a plunger which pushes the material along the portion of the passage in which non-reactive gas is trapped (a gooseneck, nozzle and sprue bushing, as later described) would not reach the passage to push the material away from an opening for flushing the passage. Indeed, the plunger would push the material toward and out of such an opening. For these and other reasons, the same techniques with which cold chamber apparatus is purged are not suitable for hot chamber die casting apparatus.

SUMMARY OF THE INVENTION

It is an object of the invention to provide a method and apparatus for casting articles with greatly reduced porosity in a hot chamber die casting machine which is, more particularly, applicable to die casting zinc alloys.

The invention will be described with reference to hot chamber pressure die casting apparatus which injects molten metal into a die cavity from a continuous supply through an enclosed passage. The enclosed passage comprises a sprue bushing in the die which communicates with one end of a hollow nozzle and a gooseneck which communicates with the other end of the nozzle. The gooseneck curves downwardly from the nozzle into a holding furnace full of molten metal and upwardly in the furnace to form a chamber for a plunger which injects the molten metal into the die cavity. A bore at the upper end of the chamber, but initially below the plunger, admits molten metal from the furnace into the chamber. Downward movement of the plunger then closes the bore from the chamber and injects the metal through the gooseneck, nozzle, and sprue bushing for filling the die cavity.

In the method of the invention, pore-free die castings are formed when a reactive gas flushes air (or other non-reactive gas or vapor) from the sprue bushing, nozzle, and at least a portion of the gooseneck, as well as from the die cavity. The reactive gas replaces the air in the sprue bushing, nozzle, and portion of the gooseneck (and the die cavity) so that minimal air is forced from the sprue bushing, nozzle and gooseneck into the die cavity as the material is injected therethrough into the die cavity. Air or other non-reactive gas in the die cavity would form pores in the article cast from the material.

It has been possible heretofore to purge the means which fill a die cavity only in cold chamber die casting apparatus. The chamber on this apparatus is open to receive individual shots of material to be cast and could thus also receive easily a purging reactive gas. In hot chamber apparatus, however, the passage in the gooseneck, nozzle and sprue bushing through which the die cavity is filled is enclosed. There has thus been no way of introducing a purging reactive gas to the passage.

Hot chamber apparatus, however, is desirable for casting certain metals such as zinc. Individual shots of the metal have to be ladled into the chamber in cold chamber apparatus. In hot chamber apparatus, on the other hand, the holding furnace forms a continuous supply of metal for casting. Hot chamber apparatus thus saves the time and difficulty of ladling individual shots of metal. Thus, ever since the pore free method of die casting was introduced by the Radtke and Eck patent in 1968, there has been an unresolved need to combine the advantages of hot chamber apparatus with the advantages of the pore free die casting technique. Applicant has now filled this need.

Hot chamber apparatus for practicing the method has a bore which communicates with the passage in the gooseneck through which, in cooperation with the nozzle and sprue bushing, the material is injected into the die cavity. A valve which seats in one end of the bore opens the bore while the reactive gas flushes air from the sprue bushing, nozzle, and portion of the passage in the gooseneck between the nozzle and the bore, as well as from the die cavity, and closes the bore while the material is being injected into the die cavity so that the material is injected only into the die cavity.

In one mode of operating the apparatus according to the method, the passage receives the reactive gas from means communicating with the die cavity for flushing air from the die cavity, sprue bushing, nozzle, gooseneck through the bore, the valve then being open to exhaust the air through the bore. After purging the die cavity and passage, the valve closes and the material is injected into the die, the closed valve then preventing the material from escaping through the bore so that the material is injected only into the die cavity.

In another mode of operating the apparatus, the reactive gas is introduced past the valve for purging the gooseneck, nozzle, sprue bushing, and die cavity, the air purged therefrom escaping through an outlet from the die cavity. After flushing the air from the gooseneck, nozzle, sprue bushing, and die cavity, the valve closes to prevent the material then injected into the die cavity from passing along the bore into the apparatus which supplied the reactive gas.

Those in the art will readily appreciate from the description of the apparatus that the method can best be carried out when the bore communicates with the passage at a point where the portion of the passage between the nozzle and the bore is a substantial portion of the length of the passage between the nozzle and the material to be injected. When the apparatus is so designed, a substantial portion or all of the passage is purged by the reactive gas to minimize the amount of air which may be trapped in the passage between the bore and the material to be injected.

The preferred form of the apparatus additionally comprises a heating element which heats the valve (or its cooperative valve seat at one end of the bore) for preventing material which may reach the valve through the bore during injection from solidifying between the valve and its seat. Such solidified material could prevent operation of the valve.

DESCRIPTION OF THE DRAWING

A preferred embodiment for practicing the method, which is intended to illustrate but not to limit the invention, will now be described with reference to the drawing which shows an elevation of the preferred embodiment partly in cross-section.

DESCRIPTION OF THE PREFERRED EMBODIMENT FOR THE PREFERRED PRACTICE OF THE METHOD

The drawing schematically illustrates portions of known hot chamber apparatus for injecting molten metal 10 from a holding furnace 11 into a die cavity 12 through an enclosed passage 22. The die cavity is formed between two die members 14 one of which is pressed against the other, as by piston and cylinder 16, for substantially closing the die cavity. A sprue bushing 18 extends from the die cavity and communicates with one end of a hollow nozzle 20; the other end of the nozzle communicates with a gooseneck 24 to together form the passage. The gooseneck extends into the molten metal and curves upwardly at one end to form a chamber 26 in a portion of the passage 22 remote from the nozzle. A plunger 28 is initially positioned in the chamber 26 above a bore 30 which admits the molten metal 10 into the chamber. The plunger is connected to a piston and cylinder device 32 for moving the plunger downwardly into the chamber to first close the portion of the chamber 26 below the plunger from the bore 30 and then to inject the molten metal through the passage into the die cavity. As earlier described, apparatus of this type for injecting molten metal into a die cavity is well-known.

The preferred embodiment additionally comprises a bore 40 which extends through the gooseneck 24 from one end at the passage 22 to an opposite end which forms a seat 42 for a valve stem 44. Inasmuch as the preferred embodiment is intended for die casting molten metal, and particularly because the bore 40 and valve seat 42 are formed integrally with the gooseneck which is bathed in the molten metal, heat will be conducted through the gooseneck to the valve seat 42 and valve stem 44. A piston and cylinder device 46, which is connected to the valve stem 44 for raising and lowering the valve stem from the valve seat, is therefore thermally insulated from the gooseneck and valve stem to protect seals and other structure of the piston and cylinder device.

A bracket 48 which supports the cylinder of piston and cylinder device 46 on the gooseneck 24 has thermal insulation 50 at one or both ends of the bracket. A piston rod 52 of the piston and cylinder device is operatively connected to the valve stem 44 with additional thermal insulation 54. The piston and cylinder 46 is thus maintained at a lower temperature than the gooseneck 24 so as to avoid heat deterioration of the piston and cylinder device 46.

The valve seat portion 42 of bore 40 forms a chamber which communicates with another bore 55. A bellows seal 56 extends between this chamber and the thermal insulation 54 on the valve stem to enclose the chamber (except for the bore 55). A heating element 58 surrounds the portion of the gooseneck in which the valve seat portion 42 is formed for maintaining the valve seat portion 42 at a selected temperature even higher than that produced by conduction of heat through the gooseneck from the molten metal.

A passage 60 extends through at least one die member 14 for communicating with the die cavity 12. As will be quickly apparent from the following description of the operation of the preferred embodiment, there may be more than one passage 60 (only one shown) for assuring that each portion of the die cavity 12 is purged of non-reactive gas by the reactive gas.

Description of Operation

In one mode of operating the preferred embodiment, a reactive gas at a pressure above atmospheric pressure is supplied to the end of the bore 55 remote from the chamber defined by the valve seat 42; for example, a tank (not shown) of compressed oxygen can be connected to the end of the bore 55. The piston and cylinder device 46 raises the valve stem 44 from the valve seat 42 to admit the reactive gas to the bore 40. The pressure of the reactive gas forces the gas along the bore 40 into the passage 22.

Some of the reactive gas may flush air from a portion of the passage 22 which extends between the bore 40 and the molten metal 10, but most of the reactive gas flushes air from the portion of the passage 22 which extends between the bore 40 and the nozzle 20 because the molten metal blocks the other end of the passage. Flow of the reactive gas toward the nozzle is not blocked because the passage 60 opens the die cavity and thus the passage 22 to the atmosphere. The pressure of the reactive gas then carries the gas along the passage 22 to the die cavity 12 to flush air from the passage 22, as well as the die cavity, through the passage 60. After purging the passage and die cavity with the reactive gas, piston and cylinder 46 presses the valve stem 44 against the valve seat 42 to prevent further flow of the reactive gas. The piston and cylinder 32 then injects the molten metal into the die cavity 12 through the passage 22, the valve stem 44 on the valve seat 42 preventing the molten metal from escaping through the bore 40.

In another mode of operating the preferred embodiment, the pressurized reactive gas, for example oxygen from a tank (not shown), is supplied to the end of the passage 60 remote from the die cavity 12 (an inlet valve (not shown) at passage 60 would be desirable to prevent flow of oxygen while the dies were open). Little or no reactive gas flows into the die cavity while the valve stem 44 is seated on the valve seat 42 because the valve stem blocks the bore 40 and the molten metal blocks the passage 22. Piston and cylinder 46 then raises the valve stem 44 from the valve seat 42 to permit the reactive gas to enter the die cavity 12 and flow along the passage 22 to the bore 40 to flush the air which had been in the die cavity, sprue bushing, nozzle, and gooseneck out the bore 40 and through the passage 55 to the atmosphere. After flushing the air from the passage 22, piston and cylinder 46 again seats the valve stem 44 on the valve seat portion 42 to prevent further flow of the reactive gas and piston and cylinder 32 operates the plunger to inject the molten metal into the die cavity, the pressure of the molten metal during its injection into the die cavity 12 being higher than that of the reactive gas. As before, the valve stem 44 on the valve seat 42 prevents the molten metal from escaping through the bore 40, as well as preventing further flow of the reactive gas. Relatively little molten metal, if any, will escape through the passage 60 because the molten metal quickly solidifies and plugs the relatively small passage 60 in the die.

In both modes of operation, the sprue bushing 18, nozzle 20, and portion of the passage 22 between the nozzle and the bore 40, as well as the die cavity 12, are all purged of air and filled with the reactive gas before the molten metal is injected into the die cavity. When the molten metal is injected into the die cavity, it forces all this reactive gas (and such little air as may be trapped in the passage 22 between the molten metal and the bore 40) into the die cavity 12. There then being substantially only reactive gas in the die cavity, all the gas in the die cavity reacts with the metal to form a pore-free casting.

In both modes of operation, the heating element 58 maintains the valve seat 42 and the valve stem 44 at a temperature above the melting point of the metal so that any metal which may reach the valve stem during injection will not solidify between the valve stem and the valve seat to prevent operation of the valve when it is next desired to purge air from the passage 22. The heat from the heating element 58 is insulated from the piston and cylinder 46 by the thermal insulation 50, 54, as before described.

Although the invention has been described with reference to one preferred embodiment for flushing air from a sprue bushing, nozzle, and gooseneck, as well as from the die cavity, it will be understood that other hot chamber apparatus may be adapted for practicing the invention.

I claim:

1. A method of die casting in hot chamber apparatus having a die, a cavity in the die in which liquid material is cast, enclosed means such as a sprue bushing, hollow nozzle, and gooseneck extending from a continuous supply of the material to the die for filling the die cavity with the material, a bore communicating with the means for filling the die cavity, and a passage extending from the die cavity, the method comprising the steps of:

flushing the means for filling the die cavity, as well as the die cavity, with a reactive gas supplied under pressure to the bore or the passage whereby air and other non-reactive gas and vapor is purged therefrom and replaced by the reactive gas so that minimal air and other nonreactive gas and vapor is forced into the die cavity ahead of the material as it fills the die cavity;

closing the bore after flushing the means for filling the die cavity and the die cavity with the reactive gas so that the material will not escape through the bore; and after closing the bore, filling the die cavity with the material through the means for filling the die cavity whereby only the material and the reactive gas are in the die cavity, the reactive gas reacting with the material to form a solid compound therewith, and the material then forming a low porosity casting in the die cavity.

2. A method as set forth in claim 1 wherein the apparatus has valve means for closing the bore, the method additionally comprising heating the valve means to a temperature at which material which reaches the valve means through the bore during filling of the die cavity will not solidify about the valve means to prevent its further operation.

3. In hot chamber die-casting apparatus having a die, a cavity in the die in which liquid material is cast, and enclosed means, such as a sprue bushing, hollow nozzle, and gooseneck, for filling the die cavity with the material, apparatus for flushing air and other non-reactive gas and vapor from the means for filling the die cavity, as well as from the die cavity, which comprises:

a bore defined by and communicating at one end with the means for filling the die cavity with the material;

a valve seat at the other end of the bore;

a valve stem cooperative with the valve seat for opening and closing the bore;

means for moving the valve stem having one end to open and close the bore; and a passage defined by the die and communicating with the die cavity whereby a reactive gas supplied under pressure to the bore or the passage communicating with the die cavity flushes the air and other non-reactive gas and vapor from the means for filling the die cavity with the material, as well as from the die cavity, the air and non-reactive gas and vapor being exhausted to atmosphere through the other of the bore and the passage while the bore is open, and the valve stem then closing the bore for filling only the die cavity with the material, the material pushing the reactive gas from the means for filling the die cavity into the die cavity as it fills the die cavity, the reactive gas reacting with the material to form a solid compound therewith and the material then forming a low porosity casting in the die cavity.

4. Apparatus as set forth in claim 3 additionally comprising means for heating the valve seat and valve stem to a temperature at which material which reaches the valve seat through the bore during filling of the die cavity will not solidify between the valve seat and valve stem to prevent further operation of the valve stem.

5. Apparatus as set forth in claim 3 wherein the valve seat defines a chamber about the valve stem and additionally comprising another bore defined by the means for filling the die cavity, which bore communicates with the chamber, and means over the chamber and cooperative with the valve stem for movably sealing the chamber about the valve stem.

6. Apparatus as set forth in claim 5 wherein the movable sealing means comprise a bellows seal connected at one end to the valve stem and at the other end about the chamber.

7. Apparatus as set forth in claim 3 additionally comprising thermal insulation material between the means for moving the valve stem and the valve stem.

8. Apparatus as set forth in claim 3 additionally comprising thermal insulation material between the means for moving the valve stem and the means for filling the die cavity.

* * * * *

UNITED STATES PATENT AND TRADEMARK OFFICE

CERTIFICATE OF CORRECTION

PATENT NO. : 3,999,593

DATED : December 28, 1976

INVENTOR(S) : Willard D. Kaiser

It is certified that error appears in the above-identified patent and that said Letters Patent are hereby corrected as shown below:

Column 7, line 26, after "stem" insert --having one end--; line 28, delete "having one end" after --stem--.

Signed and Sealed this

Twenty-ninth Day of March 1977

[SEAL]

*Attest:*

RUTH C. MASON
*Attesting Officer*

C. MARSHALL DANN
*Commissioner of Patents and Trademarks*